US006513303B2

(12) United States Patent
Neri

(10) Patent No.: US 6,513,303 B2
(45) Date of Patent: Feb. 4, 2003

(54) METHOD AND UNIT FOR BANDING GROUPS OF BANK NOTES

(75) Inventor: Armando Neri, Bologna (IT)

(73) Assignee: Currency Systems International, Inc., Irving, TX (US)

( * ) Notice: Subject to any disclaimer, the term of this patent is extended or adjusted under 35 U.S.C. 154(b) by 0 days.

(21) Appl. No.: 09/897,941

(22) Filed: Jul. 5, 2001

(65) Prior Publication Data

US 2002/0005026 A1 Jan. 17, 2002

(30) Foreign Application Priority Data

Jul. 6, 2000 (IT) ..... B0200A400

(51) Int. Cl.[7] ..... B65B 13/02

(52) U.S. Cl. ..... 53/399; 53/589; 100/2; 100/33 PB

(58) Field of Search ..... 53/399, 589, 375.8; 100/2, 14, 33 PB

(56) References Cited

U.S. PATENT DOCUMENTS 3,364,847 A 1/1968 Francois
3,527,343 A * 9/1970 Rutter ..... 53/399
3,987,901 A * 10/1976 Dullinger ..... 206/451
4,627,219 A * 12/1986 Omori ..... 53/399
4,845,917 A * 7/1989 Omura et al. ..... 209/534
4,910,944 A 3/1990 Segalowitz
5,747,131 A * 5/1998 Kreckel ..... 156/162
5,775,058 A * 7/1998 Hirschek ..... 53/399

* cited by examiner

*Primary Examiner*—Ted Kavanaugh
(74) *Attorney, Agent, or Firm*—Colin P. Cahoon; Carstens, Yee & Cahoon

(57) ABSTRACT

A stack of bank notes with substantially parallelepiped shape and a defined stacking axis is formed by a forming machine and fed by a gripper to a banding unit equipped with a part which receives and grips each stack, which operates in conjunction with a banding machine for the application of a pair of first retaining bands, each wrapped around the stack at its opposite ends and at least one second retaining band which is wrapped around the stack in such a way that it is in contact with two transversal surfaces and two lateral surfaces, so that portions of the first bands and second band overlap one another on each of the two opposite transversal surfaces. The part feeds the stack bound with the bands to sealing parts located opposite at least one of the transversal surfaces of the stack, which seal together the above-mentioned overlapping portions of the two bands by contact with contrast and protection plates which are inserted between the overlapping zones of the bands and the transversal surfaces of the stack in such a way that they operate in conjunction with the sealing means.

6 Claims, 6 Drawing Sheets

1
2
2a
3
4
5
6
7
8
9
10
11
12
13
14
15
16
17
18
19
20
21
22
23
25
27
36
37
41
42
43
44
45
46
47
48
49
P1
P3
F

METHOD AND UNIT FOR BANDING GROUPS OF BANK NOTES

BACKGROUND OF THE INVENTION

The present invention relates to a method for banding groups of bank notes.

The present invention is advantageously applied on machines which arrange bank notes into groups then transfer them to a banding machine which applies at least one retaining band to each group of bank notes.

As is known, the institutes which issue bank notes, also known as the central banks, and commercial banks have to handle large quantities of paper money every day. For this purpose, the bank notes are first divided into groups, then placed in bags or boxes for transportation.

To hold such groups together and transport them without the risk of the notes separating and also in order to prevent tampering, bands are applied to them, securing them in position and preventing theft from them.

For this purpose, bank notes are loaded into the above-mentioned machines in succession and, once checked and divided according to their value and/or type, are sent on to the various group formation channel outfeeds.

Stacks which have a substantially parallelepiped configuration and a given stacking axis form at each of these outfeeds and, when a given number of bank notes is reached, defining one of the above-mentioned groups, they are picked up and transferred to a banding station, where a band is applied to each group.

Alternatively, the above-mentioned machines may be fed, at the infeed of each forming channel, with a succession of bundles of bank notes previously checked and banded, so that blocks of bundles of bank notes are formed at the outfeed of each of the machine forming channels, instead of blocks of individual bank notes. Like the above-mentioned groups of bank notes, the blocks of bundles are then picked up and transferred to the banding station.

Each group of bank notes or block of bundles is normally held together by one or more parallel bands, each applied around the group in such a way that they make contact with two surfaces which are transversal to said axis, one upper and one lower, and two lateral surfaces, opposite one another and parallel with the stacking axis.

Where only one band is used, it is applied around the group in a substantially central position. If two bands are used, they are normally applied at the two ends of the group.

For the above reasons, banding must be rapid, precise and must provide a strong finished product. For this reason, another band is applied, wrapped around the group in such a way that it lies transversally to the others.

However, it has been observed that, despite the application of bands using the above methods, one of the two bands may be taken off without tearing, allowing the removal of one or more bank notes. The band may then be replaced in its original position, wrapped around the stack, without leaving a trace of the theft which has taken place.

SUMMARY OF THE INVENTION

The aim of the present invention is to overcome the above-mentioned disadvantages.

Accordingly, the present invention provides a method for banding groups of bank notes arranged in stacks which have a substantially parallelepiped configuration and a defined stacking axis, the method comprising the steps of applying at least one first retaining band around the stack, in contact with two surfaces which are transversal to the stacking axis and two first lateral surfaces which are parallel with the axis, and of applying at least one second retaining band around the stack, in contact with the two transversal surfaces and two second lateral surfaces which are substantially perpendicular to the first lateral surfaces, in such a way as to obtain a zone at which the portions of the first and second bands overlap on each of the two opposite transversal surfaces. The overlapping portions of the two bands are then sealed together on at least one of the transversal surfaces.

The present invention also relates to a unit for banding groups of bank notes arranged in stacks which have a substantially parallelepiped configuration and a defined stacking axis, the unit comprising a banding unit located downstream of a machine for forming said stacks. The banding unit in turn comprises means for receiving and gripping each stack which operate in conjunction with a banding machine and are mobile through a plurality of operating positions in order to apply at least a first retaining band around the stack, in contact with two surfaces which are transversal to the stacking axis and two first lateral surfaces which are parallel with the axis, and at least one second retaining band around the stack, in contact with the two transversal surfaces and the two second lateral surfaces which are substantially perpendicular to the first lateral surfaces. This is done in order to obtain zones at which the portions of the first and second bands overlap on each of the two opposite transversal surfaces. The unit also comprises sealing means which, for each of the band overlapping zones, have sealing parts positioned opposite at least one of the transversal surfaces of the stack. These sealing means seal the overlapping portions of the two bands together on at least one of the transversal surfaces.

BRIEF DESCRIPTION OF THE DRAWINGS

The invention will now be described with reference to the accompanying drawings, which illustrate several preferred embodiments without limiting the scope of its application and in which.

DESCRIPTION OF THE PREFERRED EMBODIMENTS

Figures 1, 1A:
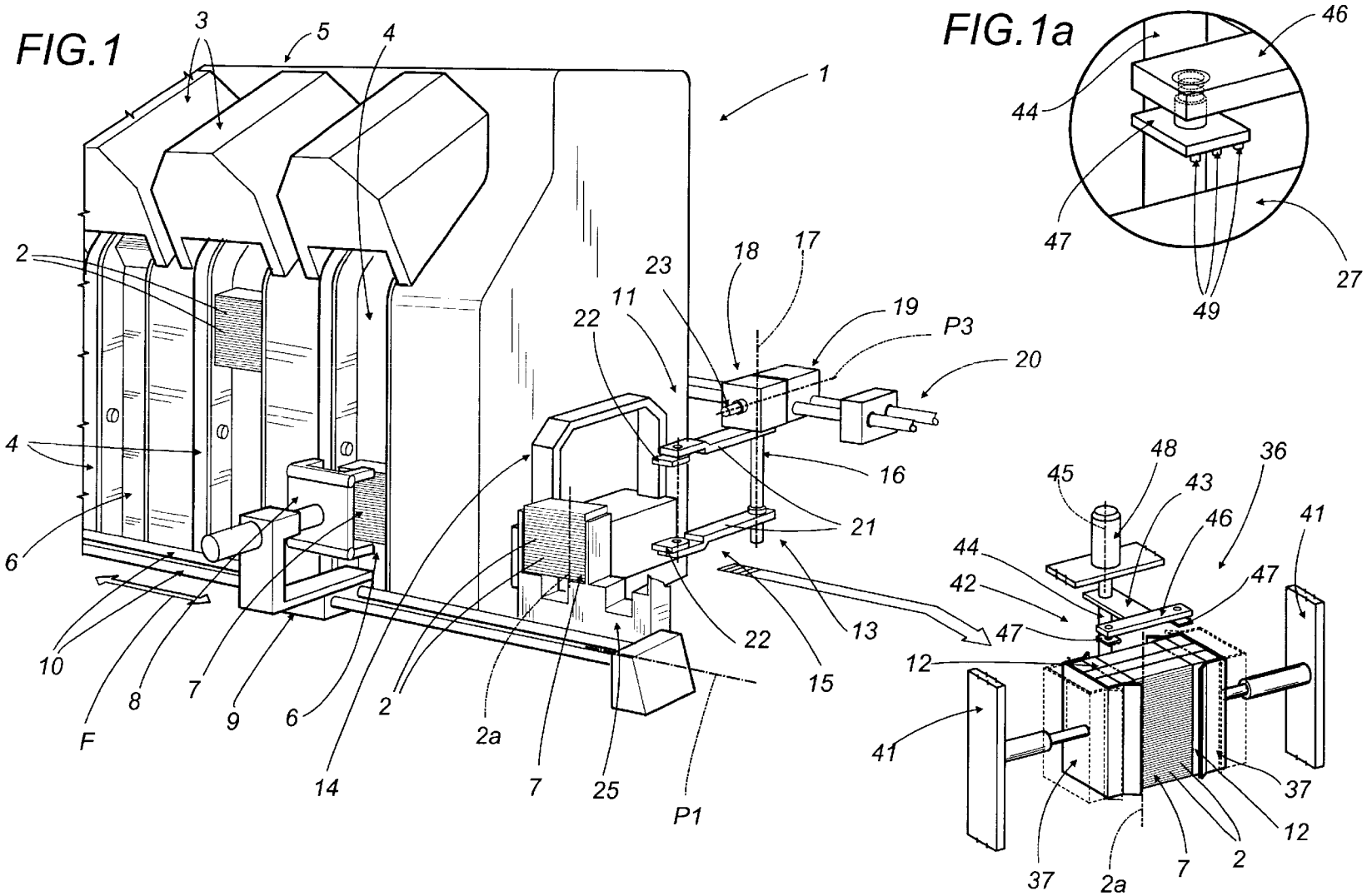
FIG. 1 is a schematic perspective view, with some parts cut away for the purpose of clarity, of a portion of a machine for forming groups of bank notes, equipped with a unit for banding groups of bank notes made in accordance with the present invention.
FIG. 1*a* illustrates a detail from FIG. 1.

With reference to FIG. 1, the numeral 1 indicates as a whole a portion of a machine for creating groups of bank notes 2.

The machine 1 comprises a plurality of forming modules 3 equipped with forming channels 4, along which the bank notes 2, from a station 5 (only partially shown in the schematic illustration in FIG. 1), which controls them, are fed in order to form orderly stacks 7 of bank notes 2 which have a substantially parallelepiped configuration and a stacking axis 2*a* at the outfeed 6 of each channel 4.

In the embodiment illustrated in FIG. 1, the machine 1 comprises a gripper 8 supported by a slide 9 which runs along guides 10 extending along a given path P1 passing substantially in front of the forming modules 3 and allowing the successive, cyclical pick up of individual stacks 7 of bank notes 2 from each of the forming channel 4 outfeeds 6. The stacks are then transferred to a banding unit 11 located at the side of the machine 1 and designed to apply at least one retaining band 12 to each stack 7.

The banding unit 11 comprises a part 13 which receives and grips each stack 7 from the gripper 8, which can move the stack 7 towards a banding machine, of the known type, schematically illustrated and labeled 14, which is part of the banding unit 11.

As illustrated in FIGS. 1 to 7, the part 13 which receives and grips the stacks comprises a clamp 15 for gripping the stack 7 supported by a support column 16 extending along an axis 17 parallel with the bank note 2 stacking axis 2*a* and supported by a block 18 connected to a slide 19 which can move along guides 20 along a second path P2 which is substantially parallel with the first path P1. In this way the stacks 7 are moved towards and away from the banding machine 14.

The block 18 is connected to the slide 19 by an actuator of the known type, schematically illustrated and labeled 23, and can move the clamp 15 in both directions along a third path P3 which is transversal to the paths P1 and P2, between a position in which the gripper 8 picks up the stacks 7 and a position in which it has transferred the stacks 7 so that they are substantially opposite the banding machine 14.

In particular, the clamp 15 has two gripper arms 21, one upper and one lower, which allow the clamp 15 to grip the stack 7 of bank notes 2, with jaws 22 at the free end of each arm 21, and which move towards and away from one another along the axis 17 of the support element 16, driven by actuators of the known type and not illustrated, located inside the block 18, which move the arms 21 along the axis 17 in both directions, adapting to the shape of the stack 7.

The two jaws 22 are supported in such a way that they can rotate at the free ends of the arms 21 and can rotate about a shared axis 24 which is parallel with the axis 17, driven by drive means, also of the known type and not illustrated, located inside the block 18 and able to make at least the upper jaw 22 rotate about the axis 24, so that each stack 7 supported and gripped by the jaws 22 can be rotated about the axis 24.

In practice, as described above and schematically illustrated in FIGS. 1 to 7, the slide 9, moving along the path P1 in the direction indicated by the arrow F, cyclically moves the gripper 8 between a first operating position, in which it reaches the outfeed 6 of a forming module 4, picking up a stack 7 formed, and a second operating position, in which it moves away from the forming modules 4 to the banding unit 11, stopping in front of the clamp 15, where it releases the stack 7 to the clamp 15 before returning to its previous transfer position, in which it is drawn back.

As illustrated in FIG. 1, the machine 1 may be fitted with a buffer magazine 25, located between the machine 1 and the banding unit 11 and designed to receive orderly stacks 7 of bank notes 2 from the gripper 8 which deposits a stack 7 on the magazine 25, and to supply the stacks 7 to the clamp 15.

Figure 2:
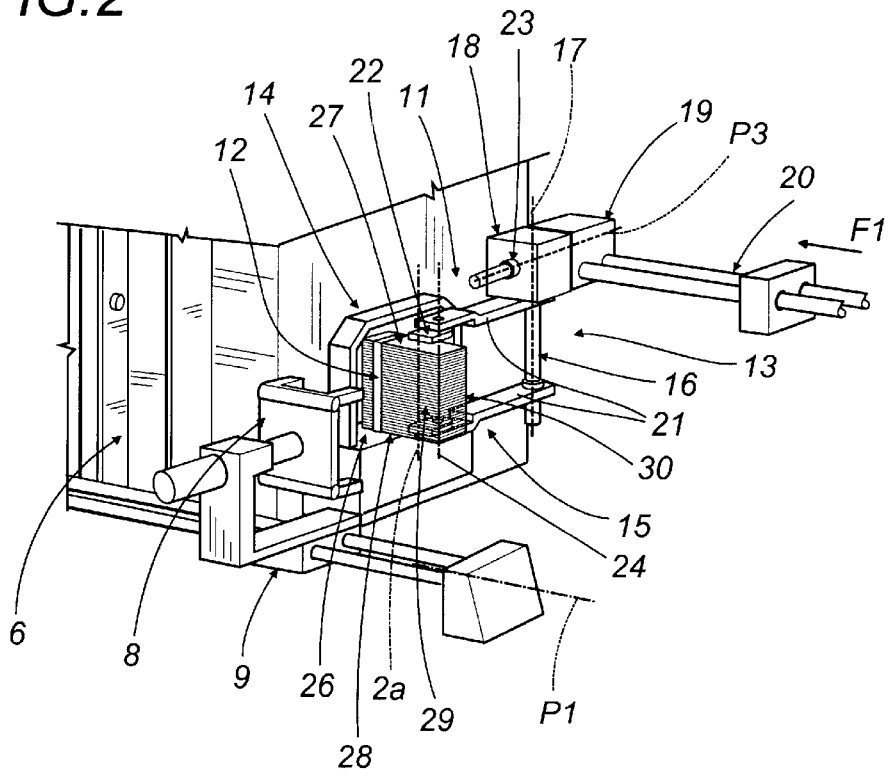
FIGS. 2 to 11 illustrate details from FIG. 1 in a succession of operating steps for the composition of a banded group of bank notes.

As is schematically illustrated in FIGS. 2 to 7, the part 13 which receives and grips the stacks moves cyclically and starting at a first position which is not illustrated, in which the clamp 15 has received a stack 7 of bank notes 2 from the gripper 8, or has picked up the stack 7 from the magazine 25, through a plurality of successive positions which are defined by a second operating position, illustrated in FIG. 2, determined by the movement of the slide 19 along the guides 20 in the direction indicated by arrow F1, before the entire part 13 moves towards the banding machine 14 and a first lateral end 26 of the stack 7 of bank notes 2 makes contact with the banding machine 14. The latter applies a first band 12 to the end 26 of the stack 7, in such a way that the band 12 makes contact with two surfaces which are transversal to the stacking axis 2*a*, the upper surface labeled 27 and the lower surface 28, and with two lateral surfaces which are parallel with the axis 2*a*, labeled 29 and 30.

Figure 3:
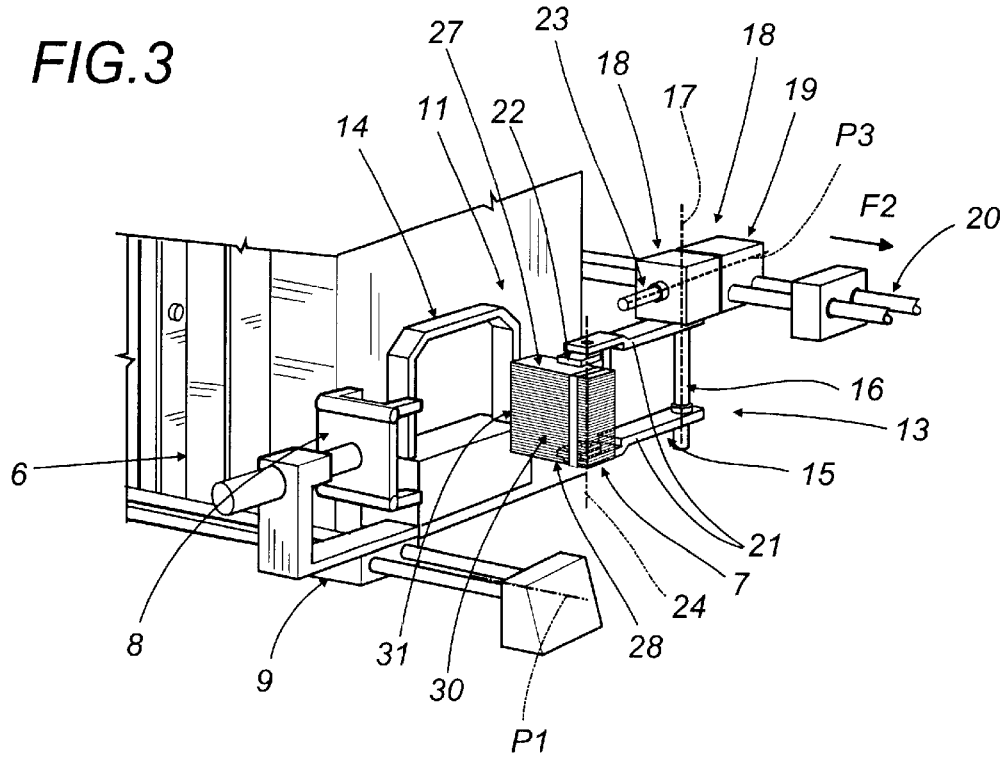

The third operating position, illustrated in FIG. 3, is determined by the movement of the slide 19 along the guides 20 in the direction indicated by arrow F2, following which the entire part 13 moves away from the banding machine 14 and the stack 7 is removed from the banding machine 14. In the third operating position, the jaws 22 of the clamp 15 turn the stack 7 through 180° about the axis of rotation 24, positioning the stack 7 so that its second lateral end 31, opposite the first 26, is in front of the banding machine 14.

Figure 4:
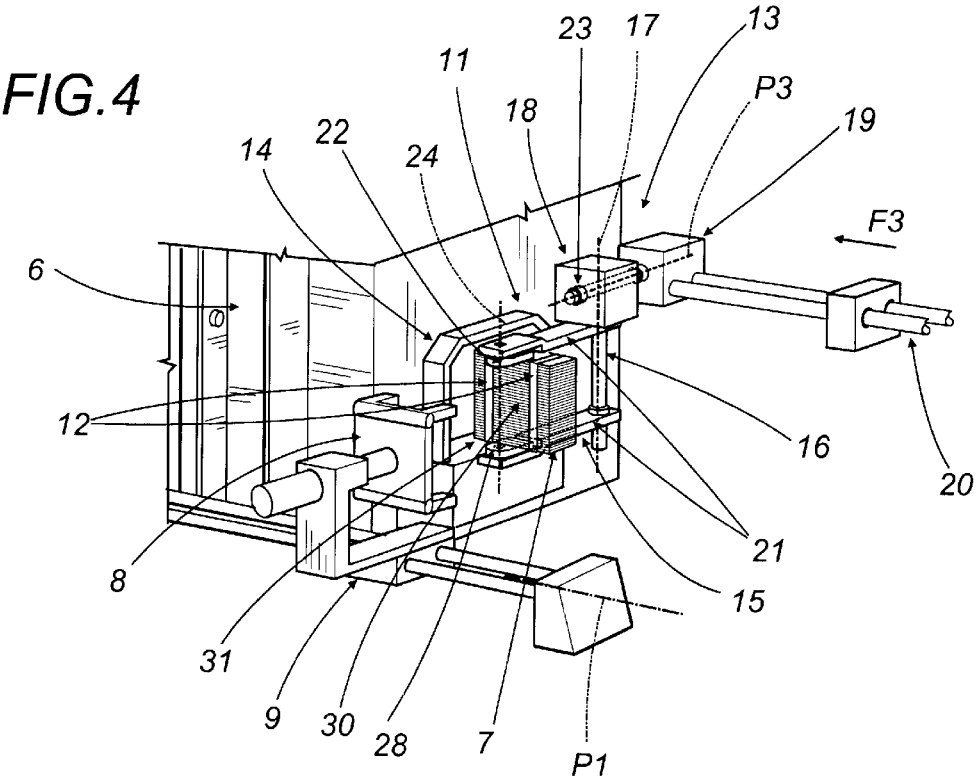

The fourth operating position, illustrated in FIG. 4, is similarly determined by a further second operating position, defined by a subsequent movement of the slide 19 along the guides 20 in the direction indicated by arrow F3, after which the entire part 13 moves towards the banding machine 14 and the second lateral end 31 of the stack 7 of bank notes 2 makes contact with the banding machine 14, which applies a second band 12 to the end 31 of the stack 7, wrapping it around the two transversal surfaces 27 and 28 and the two lateral surfaces 29 and 30 of the stack 7.

Figure 5:
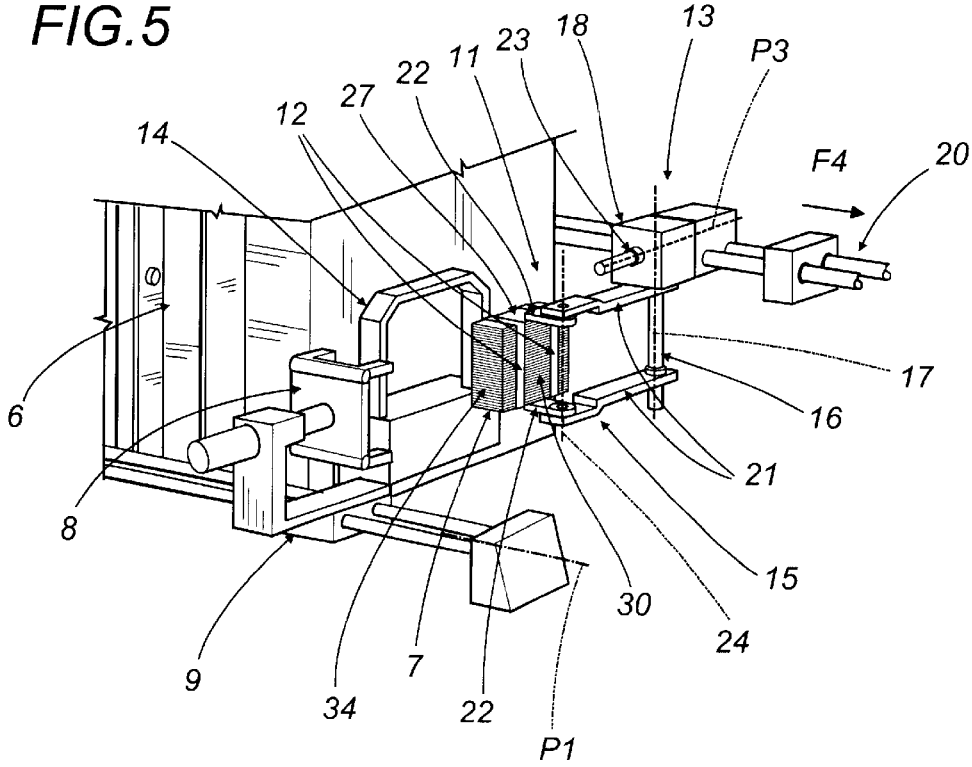

The fifth operating position, illustrated in FIG. 5 is similarly determined by a further third operating position, defined by a subsequent movement of the slide 19 along the guides 20 in the direction indicated by arrow F4, after which the entire part 13 moves away from the banding machine 14 and the stack 7 is removed from the banding machine 14. In this fifth operating position, the jaws 22 of the clamp 15 turn the stack 7 through 90° about the axis of rotation 24, positioning the stack 7 so that one of its lateral surfaces 29 or 30 is opposite the banding machine 14. In particular, in the embodiment illustrated, the stack 7 is positioned opposite the banding machine 14 so that the lateral surface 29 is furthest away from the jaws 22.

Figure 6:
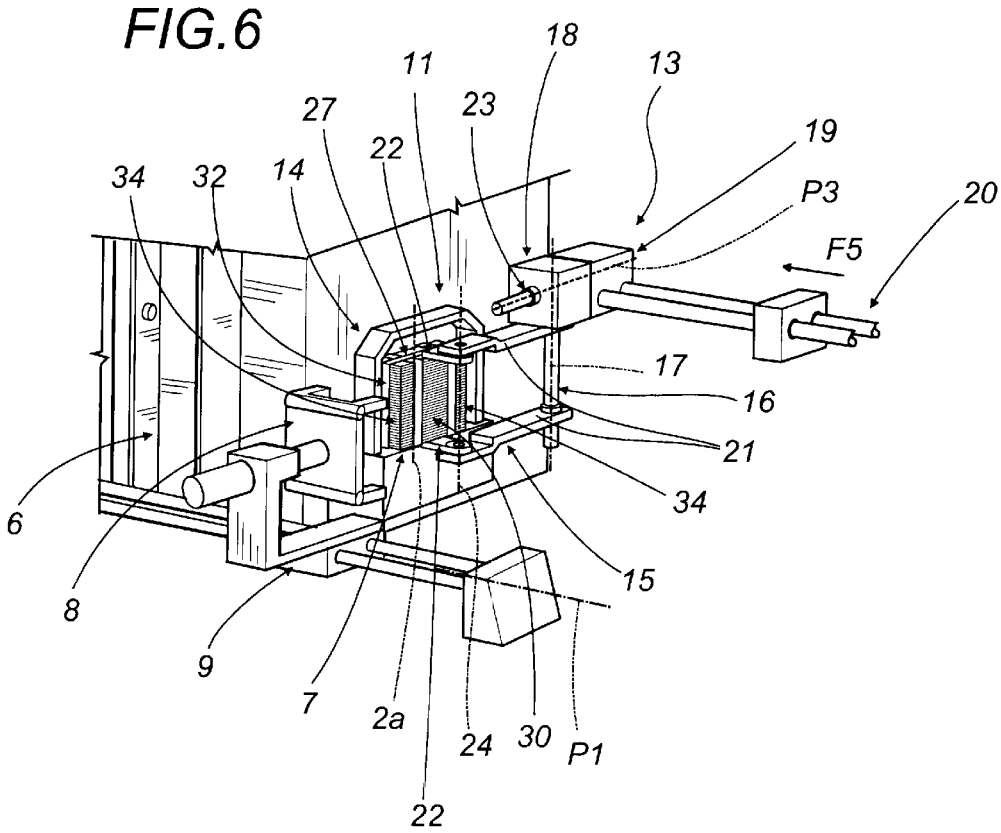

The sixth operating position, illustrated in FIG. 6, is similarly determined by a further second operating position, defined by a subsequent movement of the slide 19 along the guides 20 in the direction indicated by arrow F5, after which the entire part 13 moves towards the banding machine 14 and the stack 7 of bank notes 2 makes contact with the banding machine 14, which applies a third band, labeled 32 for clarity, to distinguish it from the first two which are labeled 12. The third band is wrapped around the stack 7 in such a way that it is in contact with the two transversal surfaces 27 and 28 and two second lateral surfaces 33 and 34 which are parallel with the stacking axis 2*a* and substantially perpendicular to the lateral surfaces 29 and 30. In this way, a stack 7 is obtained, with bands in the configuration illustrated in FIG. 12, in which, on the upper and lower transversal surfaces 27 and 28, the third band 32 is transversal to the two bands 12 and overlaps them at overlapping zones labeled 35.

Figure 12:
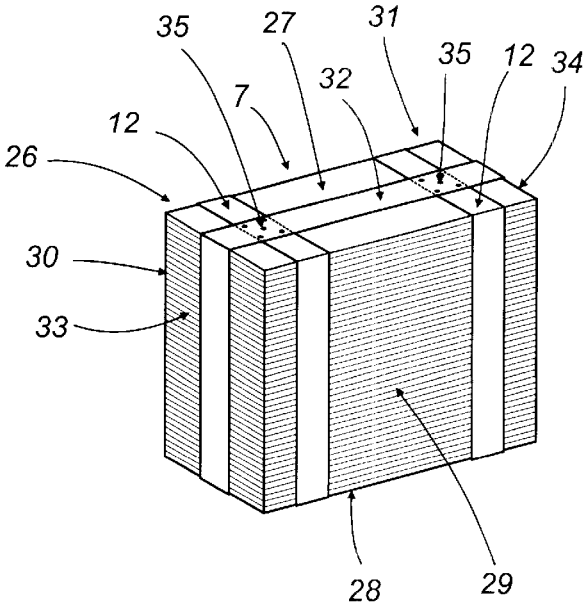
FIGS. 12 and 13 are perspective views of another two embodiments of a unit for banding bank notes made in accordance with the present invention.
Figure 13:
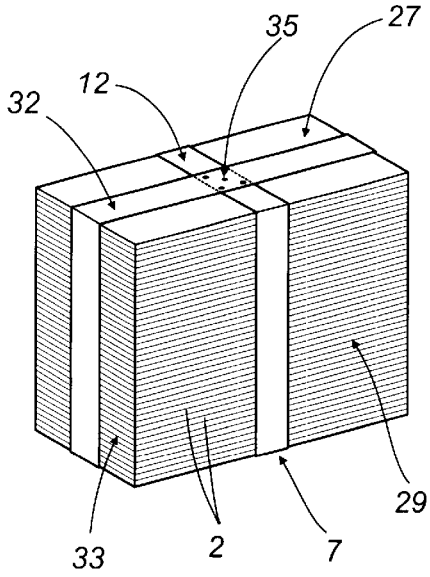

As illustrated in FIG. 13, it is useful to observe that the stack 7 may be bound with a single band 12 placed in a central position, and a band 32 which, similarly to the embodiment illustrated in FIG. 12, is transversal to the single band 12 and overlaps the latter at an overlapping zone 35 on the upper and lower transversal surfaces 27 and 28.

In this particular embodiment of the method of applying the bands 12 and 32 to make the stack 7 illustrated in FIG. 13, there are less operating steps than in the embodiment of the method described above, since fewer bands 12 have to be applied.

Figure 7:
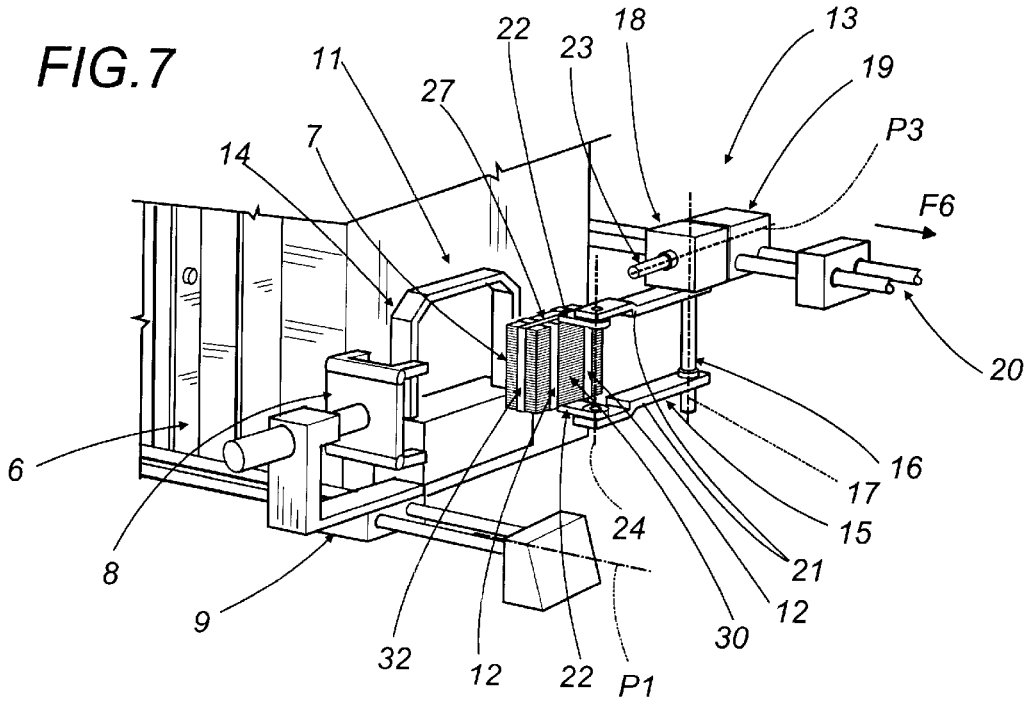

The seventh operating position, illustrated in FIG. 7, is determined by moving the banded stack 7 away from the banding machine 14 in the direction indicated by arrow F6 and, as illustrated in FIG. 1, from this position the part 13 feeds the stack 7 towards a receiving and sealing station 36 located at the side of the machine 1 and forming part of the banding unit 11.

Figure 8:
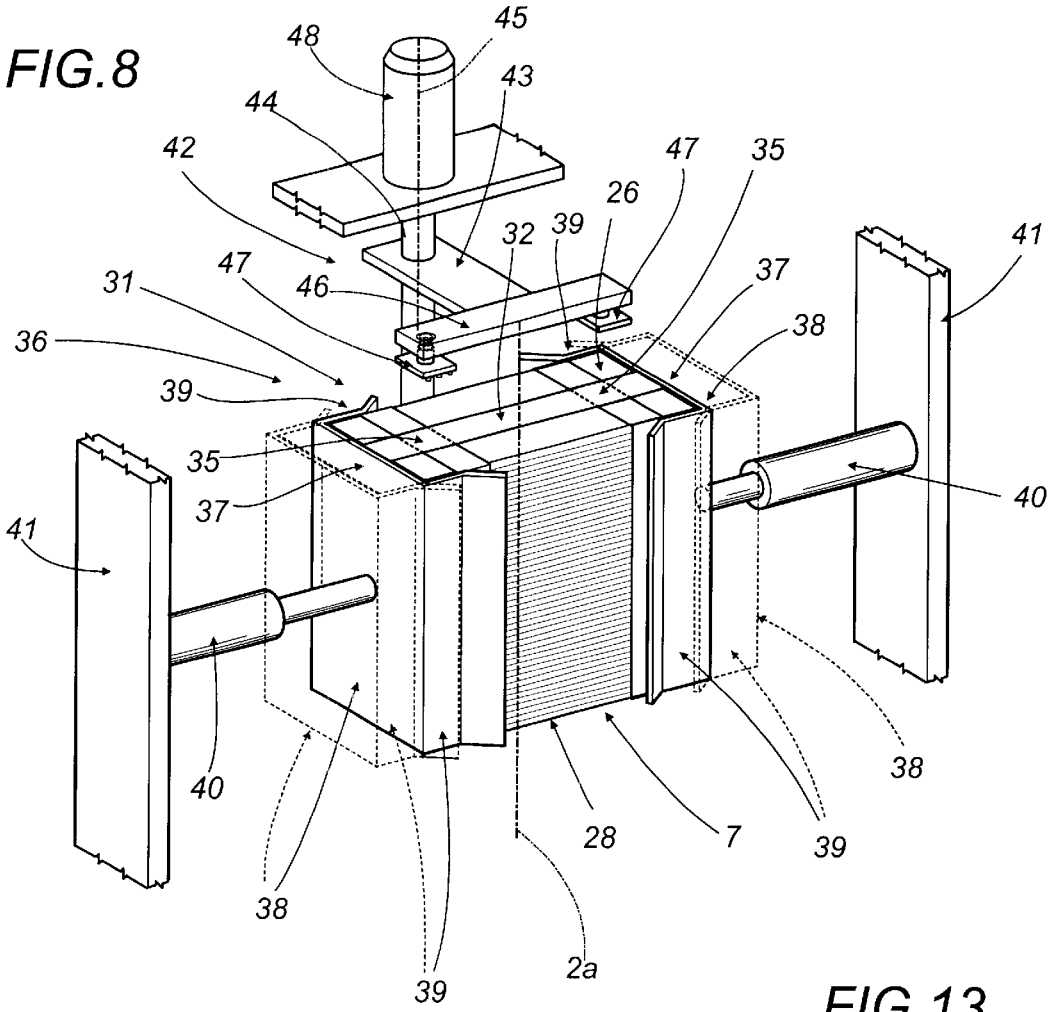

As illustrated in greater detail in FIGS. 1 and 8, the receiving and sealing station 36 comprises a pair of gripper elements 37 positioned opposite one another and designed to grip the end portions 26 and 31 of the stack 7 relative to the two opposite lateral surfaces 33 and 34 of the stack 7.

As illustrated in FIG. 8, each gripper element 37 is U-shaped, has a front wall 38 and two opposite side walls 39 which are angled away from one another at their free ends, and is mobile, driven by actuator means 40 supported by vertical brackets 41, between a position in which the gripper elements are moved away from one another, illustrated with the dashed line in FIG. 8, and a position in which they are moved towards one another, illustrated with the continuous line, in which they grip the stack 7 and hold it stably.

Figure 10:
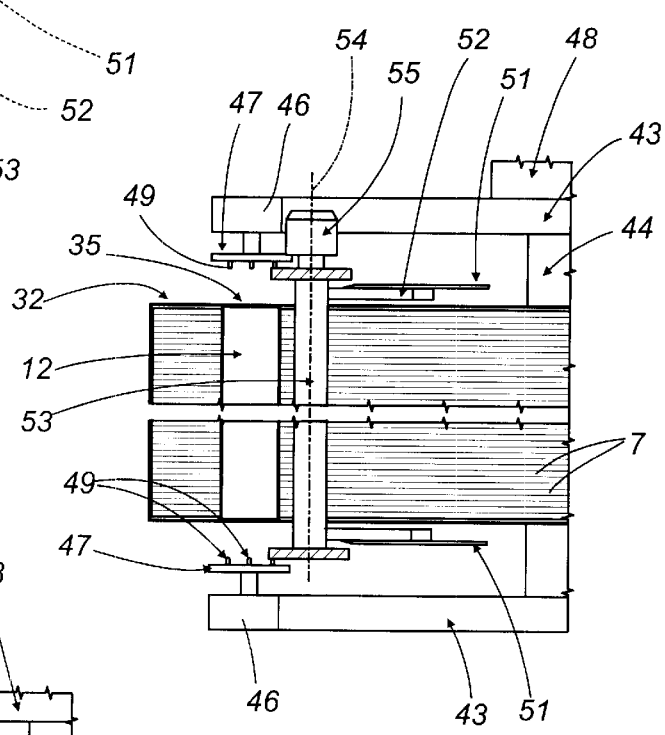
Figure 11:
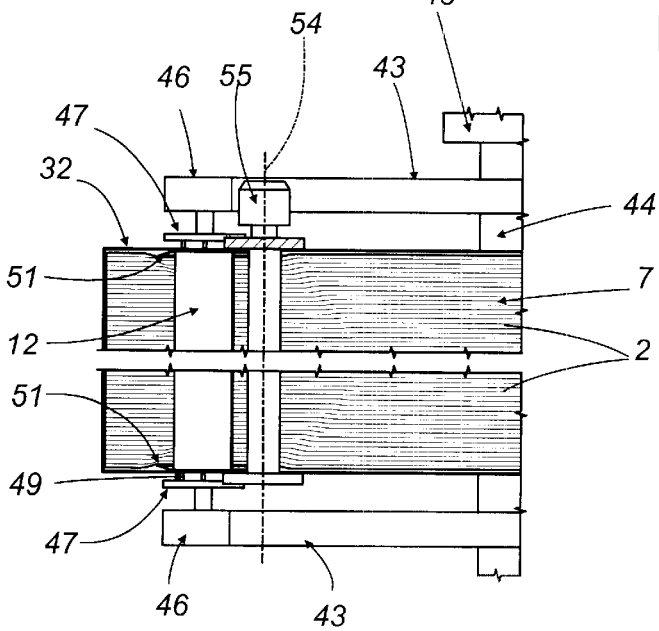

The station 36 also comprises a sealing unit 42, which works in conjunction with the gripper elements 37 to seal the zones 35 where the band 32 overlaps the bands 12, thus holding them together. In particular, as illustrated in FIGS. 8, 10 and 11, the unit 42 comprises a pair of arms 43 supported in such a way that they are offset by a vertical shaft 44 whose axis 45 is parallel with the stacking axis 2*a*. These arms are located on opposite sides of the stack 7 relative to the axis 2*a*. Each arm 43 can move, driven by an actuator 48, along the axis 45 of the shaft 44 away from and towards the stack 7. In the embodiment illustrated in FIGS. 1, 8 and 10, and relative to the stacks 7 banded by the embodiment illustrated in FIG. 12, each arm also has a transversal bracket 46 which is substantially parallel with the sections of the band 32 which make contact with the upper and lower transversal surfaces 27 and 28 of the stack 7. On each of the opposite ends of the brackets there is a sealing part 47, designed to make contact with the zones 35 where the band 32 and the bands 12 overlap.

As illustrated in FIG. 1*a*, each sealing part 47 comprises a plurality of sealing points 49, elastically supported so that they can adapt to any irregularities in the overlapping zone 35.

Figure 9:
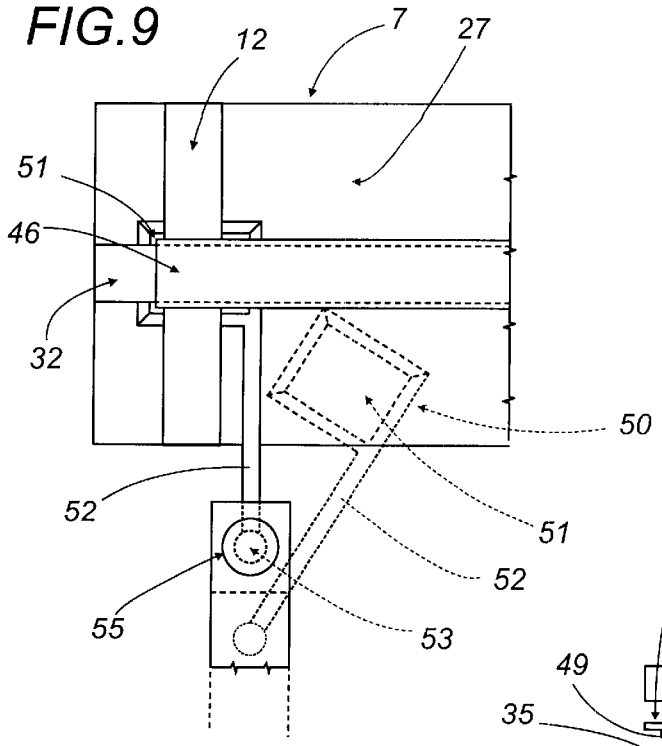

In particular, as illustrated in FIGS. 9, 10 and 11, for each sealing part 47, the sealing unit 42 comprises a contact and protection element 50 consisting of a plate 51, supported on one end of an arm 52 and lying in a plane substantially parallel with the transversal surface 27 or 28 of the stack 7, the other end of the arm pivoting on a shaft 53 whose axis 54 is parallel with the axis 45 of the shaft 44. The plate is mobile in said plane, driven by an actuator 55, between a non-operating position illustrated with a dashed line in FIG. 9 and a continuous line in FIG. 10, and an operating position, illustrated with a continuous line in FIG. 9 and FIG. 11, in which it is inserted between the overlapping zones 35 of the bands 12 and 32 and the transversal surfaces 27 and 28 of the stack 7, operating in conjunction with each sealing part 47 during the sealing step for said zones 35.

The actuator 55 also moves at least one of the contact elements 50 along the axis 54, in such a way that it is synchronized with the movement of the sealing parts 47 along the support shaft 53, and, depending on the size of the stack 7, along the stacking axis 2*a*, towards and away from the transversal surfaces 27 and 28 of the stack 7.

Following the movement of the plate 51 towards the operating position, in which it is inserted between the zones 35 where the bands 12 and 32 overlap and the respective transversal surfaces 27 and 28 of the stack 7, and the movement of each sealing part 47 towards the zones 35, the band 32 is sealed to the bands 12 at the zones 35.

This allows the bands 12 to be secured to the band 32, preventing removal of one of the bands 12 or the band 32 with the intention of removing one or more bank notes 2 from the stack 7.

What is claimed is:

1. A method for banding groups of bank notes arranged in a stack with a substantially parallelpiped shape and a defined stacking axis, said method comprising the following steps:

applying at least a pair of first retaining bands around the stack in contact with two transversal surfaces transverse to the stacking axis and two first lateral surfaces parallel with the stacking axis;

applying the at least one second retaining band comprises wrapping the at least one second retaining band around the stack so that the at least one second retaining band is in contact with the two transversal surfaces and the two second lateral surfaces, wherein the two second lateral surfaces are substantially perpendicular to the first lateral surfaces, thus obtaining two zones on each of the two opposite transversal surfaces at which the respective portions of the first and second bands overlap; and sealing the overlapping portions of the three bands together on at least one of the transversal surfaces.

2. The method according to claim 1, wherein the sealing step comprises a further step of sealing the overlapping portions of the bands on each of the two transversal surfaces.

3. The method according to claim 2, wherein the overlapping portions of the bands on each of the two transversal surfaces are sealed together simultaneously.

4. The method according to claim 1, wherein the sealing step is performed by sealing means which comprise, for each zone at which the bands overlap, sealing parts, the latter being positioned opposite at least one of the transversal surfaces of the stack.

5. The method according to claim 4, wherein the sealing means comprise at least one arm, supported in such a way that it is offset by a shaft whose axis is parallel with the stacking axis and mobile along the axis away from and towards the stack, the arm having a sealing part designed to make contact with the zones at which the band overlaps the first bands.

6. The method according to claim 5, wherein the sealing means comprise a pair of arms supported in such a way that they are offset by a vertical shaft whose axis is parallel with the stacking axis, the arms being located on opposite sides of the stack relative to the stacking axis; each arm being mobile along the axis of the shaft away from and towards the stack and comprising respective sealing parts designed to make contact with the zones at which the band and the bands overlap.

* * * * *